US005114241A

United States Patent [19]

Morrison

[11] Patent Number: 5,114,241

[45] Date of Patent: May 19, 1992

[54] DEVICE FOR INSULATING MOTOR STATORS

[76] Inventor: William O. Morrison, 7666 Ross Rd., Madison, Ohio 44057

[21] Appl. No.: 643,216

[22] Filed: Jan. 22, 1991

[51] Int. Cl.[5] ..... B01F 15/04; B01F 5/12

[52] U.S. Cl. ..... 366/162; 366/336

[58] Field of Search ..... 366/162, 160, 161, 152, 366/16, 19, 21, 138, 336, 337, 338, 339, 340; 417/343, 529, 539, 900; 222/134, 135, 137, 145

[56] References Cited

U.S. PATENT DOCUMENTS 4,118,799 10/1978 Krueger ..... 366/162

4,132,483 1/1979 Slaats ..... 366/162

4,881,820 11/1989 Luckhoff ..... 366/162

*Primary Examiner*—Robert W. Jenkins

*Attorney, Agent, or Firm*—James A. Hudak

[57] ABSTRACT

Apparatus for the precision metering of catalyst and resin material used for insulating motor stators is disclosed. The catalyst pump and the resin material pump are "sized" and driven by a common prime mover to ensure that the desired volumetric ratio of resin material to catalyst is achieved. A hypodermic needle is received within a static mixing tube to ensure that the catalyst is properly added to the resin material and thoroughly mixed with same.

5 Claims, 2 Drawing Sheets

DEVICE FOR INSULATING MOTOR STATORS

TECHNICAL FIELD

The present invention relates, in general, to a device for applying insulating material to electrical motor stators and, more particularly, to a device that provides precision metering of the catalyst and insulating material utilized.

BACKGROUND ART

Insulating material is typically applied to motor stators by means of "trickling" the material onto the stators in order to ensure that the material is applied to particular surfaces and not applied to other surfaces, such as the bore and the outer diameter of the laminations. The stator is usually supported by a mandrel and rotated during the application of the insulating material. The stator can be supported at an angle with respect to the horizontal in order to said the flow of insulating material through the slots in the motor stator. Rotation of the stator during the application of the insulating material facilitates penetration of the material into the motor windings while minimizing waste. After the insulating material has been applied to the stator, the stator is usually heated by passing current through the windings or by placing the stator in a heating oven to cure the insulating material. From the foregoing, it is apparent that the aforementioned method is not only time consuming but is rather costly since it requires the heating of the motor stator to cure the insulating material.

Another approach for insulating motor stators permits curing of the insulating material at room temperature by adding a catalyst to the resin material which is utilized as the insulating material. The use of such catalyst permits the resin material to cure at room temperature in a relatively short period of time, typically between five to ten minutes after the application of the resin material and catalyst to a rotor or motor stator. This latter approach has many advantages over the prior art in that it does not require the use of a heating oven or the passage of current through the motor winding to cure the insulating material applied to same. A distinct disadvantage of this latter approach is that the amount of catalyst (MEK peroxide) that is utilized in relation to the amount of resin material employed is extremely critical. The ratio of catalyst to resin is typically in the range of 1:50 to 1:100. Thus, precision metering of the amount of catalyst and resin material is required, and apparatus presently available does not provide such precision metering. In addition, it has been found that the catalyst can produce oxygen gas if the dispensing apparatus is "shutdown" for a period of time. Such gas produces voids in the passageways for the catalyst, thus preventing the mixing of the exact amount of the catalyst to the resin material. The foregoing oxygen gas must be purged from the system in order to ensure that the precise amount of catalyst is added to the resin material. The dispensing apparatus presently available does not provide for the purging of such gas.

Because of the foregoing, it has become desirable to develop apparatus which provides precision metering of the catalyst and the resin material to permit curing of same at room temperature and which permits the purging of any oxyge gas which is formed in the catalyst passageways within the apparatus if the apparatus has been "shut-down" for a period of time.

SUMMARY OF THE INVENTION

The present invention solves the problems associated with the prior art devices and other problems by providing apparatus which provides precision metering of the catalyst and the resin material in order to permit rapid curing of same at room temperature. The apparatus includes a hypodermic needle connected to the output of a valve which regulates the flow of catalyst from a catalyst pump. The catalyst pump and the pump which controls the amount of resin are "sized" and driven by a common prime mover to ensure that the desired volumetric ratio of resin material to catalyst is achieved and maintained. The hypodermic needle is received within a static mixing tube which, in turn, receives the resin material from its associated pump to ensure that the catalyst is properly added to the resin material and is thoroughly mixed with same.

The catalyst pump can be driven separately to purge any oxygen gas that might form in the catalyst passageways, thus ensuring that the precise amount of catalyst is dispensed by the hypodermic needle to the resin material as the resin material passes into and through the static mixing tube.

DESCRIPTION OF THE PREFERRED EMBODIMENT

Figure 1:
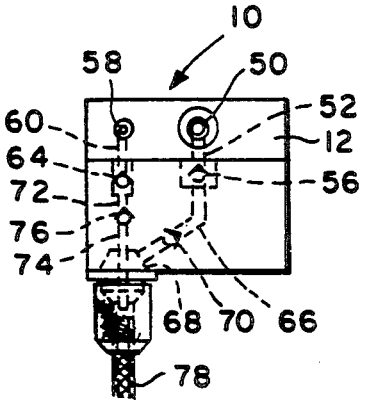
FIG. 1 is an end view of the apparatus of the present invention.
Figure 2:
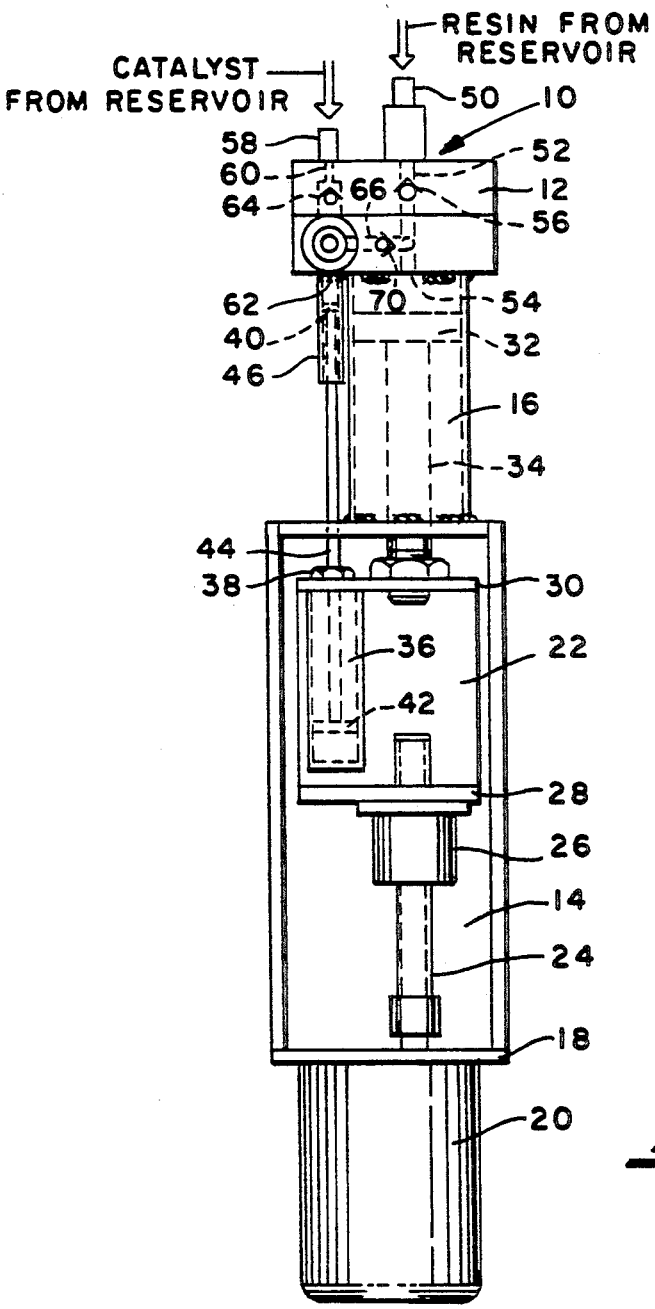
FIG. 2 is a bottom plan view of the apparatus illustrated in FIG. 1.

Referring now to the drawings where the illustrations are for the purpose of describing the preferred embodiment of the present invention and are not intended to limit the invention described herein, FIGS. 1 and 2 are an end view and bottom plan view, respectively, of a two-part mixing system 10. The system 10 includes a valve body 12, a base member 14, and a resin pump cylinder 16 interposed therebetween. The end 18 of the base member 14 that is opposite the resin pump cylinder 16 is connected to a D.C. gear motor 20.

A carriage assembly 22 is received within the base member 14 and is longitudinally movable therein by means of a drive screw 24 connected to the output of the D.C. gear motor 20 and received within a stationary nut assembly 26 which is attached to an end 28 of the carriage assembly 22. The end 28 of the carriage assembly 22 has an aperture provided therein that is aligned with the drive screw 24 permitting its passage therethrough. The opposite end 30 of the carriage assembly 22 is threadably attached to a piston 32 by means of piston rod 34. Piston 32 and piston rod 34 are received within resin pump cylinder 16 and are reciprocally movable therein. A catalyst purge cylinder 36 is positioned within carriage assembly 22 and is attached to end 30 of carriage assembly 22 by means of a nut 38. Oppositely disposed pistons 40 and 42 are connected by a piston rod 44 which is received through nut 38 in end 30 of carriage assembly 22 and is slidingly movable therein. Piston 40 is received within a catalyst pump cylinder 46 and is reciprocally movable therein. The catalyst pump cylinder 46 is substantially parallel to resin pump cylinder 16 and is attached at one end to valve body 12. Oppositely disposed piston 42 is received within the catalyst purge cylinder 36 and is reciprocally movable therein. The catalyst purge cylinder 36 is aligned with the catalyst pump cylinder 46. Advancement or retraction of the carriage assembly 22 within the base member 14 as a result of rotation of drive screw 24 results in similar advancement or retraction of pistons 32 and 40 within resin pump cylinder 16 and catalyst pump cylinder 46, respectively. Similarly, actuation of catalyst purge cylinder 36 results in advancement or retraction of piston 42 therein and advancement or retraction of piston 40 within catalyst pump cylinder 46.

Figure 3:
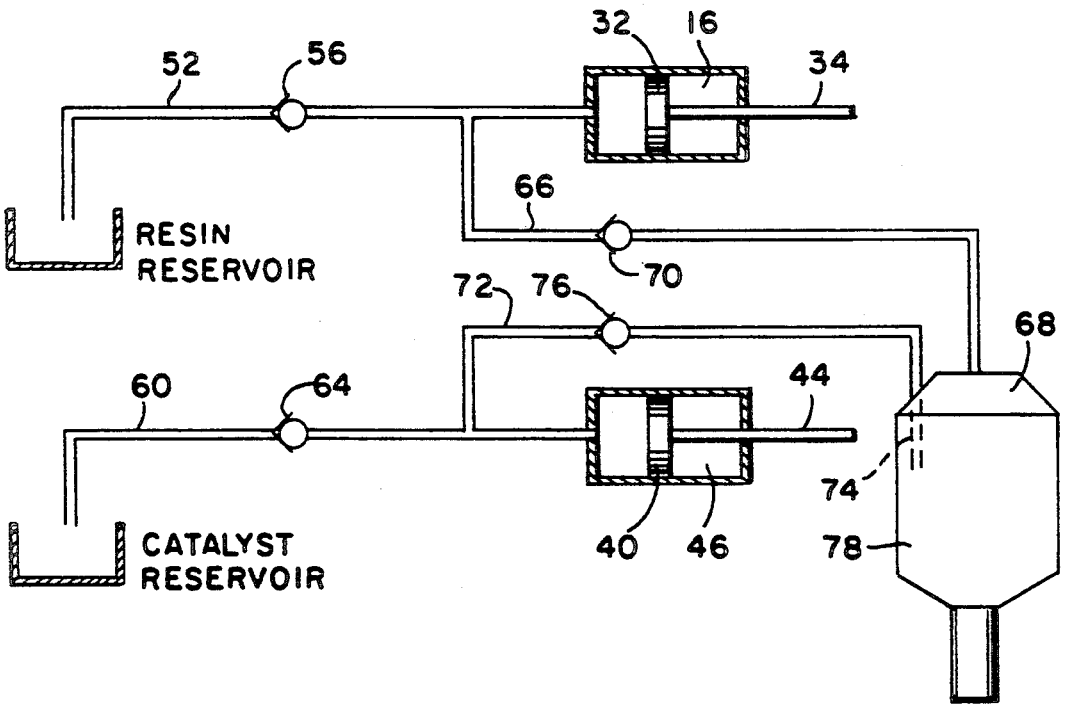
FIG. 3 is a schematic diagram of the hydraulic circuit utilized by the apparatus illustrated in FIG. 1.

Resin from a resin reservoir (not shown) enters an inlet port 50 in valve body 12, and passes therethrough via a passageway 52 to an outlet port 54 in valve body 12. Port 54 is in fluidic communication with the interior of resin pump cylinder 16. A check valve 56 is provided within passageway 52 permitting the flow of resin from the resin reservoir to the resin pump cylinder 16 via passageway 52 but preventing any backflow therethrough. Catalyst from a catalyst reservoir (not shown) enters valve body 12 via an inlet port 58 provided therein and passes therethrough via a passageway 60 to an outlet port 62 in valve body 18. Port 62 is in fluidic communication with the interior of catalyst pump cylinder 46. A check valve 64 is provided within passageway 60 permitting the flow of catalyst from the catalyst reservoir to the catalyst pump cylinder 46 via passageway 60 but preventing any backflow therethrough. The foregoing fluidic interconnections are also illustrated in FIG. 3 which is a schematic diagram of the resulting hydraulic circuit utilized in system 10. Outlet port 54 is also connected via a passageway 66 within valve body 12 to the inlet to a combining chamber 68 provided in valve body 12. A check valve 70 is provided within passageway 66 permitting the flow of resin from the resin pump cylinder 16 to the combining chamber 68 via passageway 66 but preventing any backflow therethrough. Outlet port 62 is also connected via a passageway 72 within valve body 12 to a hypodermic needle 74 which passes through combining chamber 68. A check valve 76 is provided within passageway 72 permitting the flow of catalyst from the catalyst pump cylinder 46 to the hypodermic needle 74 but preventing any backflow therethrough. A static mixing tube 78 is attached to valve body 12 adjacent the outlet of combining chamber 68 and is positioned to receive resin from the combining chamber 68 and catalyst passing through the hypodermic needle 74. It has been found that static mixing tubes such as Model No. 160-632 provided by TAH Industries, Inc. of Robbinsville, N.J. provide very satisfactory results in this case. This particular static mixing tube has an outer diameter of .370 inches, an inner diameter of .250 inches and is approximately 9.5 inches long. The end of the hypodermic needle 74 is positioned so as to be receivable within the static mixing tube 78 allowing the catalyst to be mixed with the resin as the resin passes through the static mixing tube 78.

It should be noted that the resin pump cylinder 16 and the catalyst pump cylinder 46 are sized so that their respective inner volumes provide the volumetric ratio of resin to catalyst desired. That is, the ratio of the inner volume of the resin pump cylinder 16 to the inner volume of the catalyst pump cylinder 46 is the same as the volumetric ratio of resin to catalyst desired. It should be further noted that the catalyst passageways 60, 72 within the valve body 12 are as small as possible in order to minimize gas trappage, hereinafter described.

Operationally, air is applied and maintained to the catalyst purge cylinder 36 from an air source (not shown) causing piston 42 and piston rod 44 to be retracted therein. The D.C. gear motor 26 is then selectively actuated causing rotation of drive screw 24 within the stationary nut assembly 6 resulting in the retraction of the carriage assembly 22 within the base member 14. Such retraction causes pistons 32 and 40 within the resin pump cylinder 16 and catalyst pump cylinder 46, respectively, to similarly retract. As carriage assembly 22 retracts, resin from the resin reservoir enters inlet port 50 in valve body 12 and passes through passageway 52, check valve 56 into resin pump cylinder 16 via outlet port 54 within valve body 12. Resin is prevented from passing into the combining chamber 68 via passageway 66 by check valve 70 therein. While the foregoing is occurring, catalyst from the catalyst reservoir enters inlet port 58 in valve body 12 and passes through passageway 60, check valve 64 into catalyst pump cylinder 46 via outlet port 62 within valve body 12. Catalyst is prevented from passing into the static mixing tube 78 via passageway 72 by check valve 76 therein. After the resin pump cylinder 16 and the catalyst pump cylinder 46 have been filed with resin and catalyst, respectively, the carriage assembly 22 is caused to advance within the base member 14 by actuation of the D.C. gear motor 20 causing rotation in the opposite direction of the drive screw 24 within the stationary nut assembly 26. The advancement of carriage assembly 22 causes advancement of pistons 32 and 40 within the resin pump cylinder 16 and catalyst pump cylinder 46, respectively. Advancement of piston 32 causes the resin within the resin pump cylinder 16 to pass through passageway 66, check valve 70, combining chamber 68 to the static mixing tube 78. Similarly, the advancement of piston 40 causes the catalyst within the catalyst pump cylinder 46 to pass through passageway 72, check valve 76 and hypodermic needle 74 to the static mixing tube 78. In this manner, the catalyst is added to the resin as it passes through the static mixing tube 78. While the foregoing is occurring, the resin within the resin pump cylinder 16 and the catalyst within the catalyst pump cylinder 46 are prevented from passing into the resin reservoir and catalyst reservoir by means of check valves 56 and 64, respectively.

From the foregoing, it is apparent that the ratio of resin to catalyst delivered to the static mixing tube 78 is determined by the ratio of the inner volume of the resin pump cylinder 16 to the inner volume of the catalyst pump cylinder 46. It has been found that high ratio mixing, such as 100 to 1 of resin to catalyst, can be achieved with the foregoing apparatus. Exceptional results have been achieved when using Pedigree No. 70 polyester resin produced by P.D. George Co. of St. Louis, MO as the resin and MEK peroxide as the catalyst and then applying the resulting mixture to electrical motor windings as an insulating material. In this case, the MEK peroxide acts as a curing agent for the resin permitting rapid curing thereof at room temperature. Rapid curing of the insulation on the motor windings, without the use of heat, is extremely desirable inasmuch as it increases winding production rate and reduces power requirements since heating is not required.

It has been found that the use of MEK peroxide as the catalyst in the foregoing motor winding insulation application results in the creation of oxygen gas when the system has been "shut-down" for a period of time. The creation of the foregoing oxygen gas creates voids in passageways 60, 72 within the valve body 12. These voids should be eliminated prior to "start-up" of the system in order to ensure that the desired ratio of resin to catalyst will be delivered to the static mixing tube 78. In order to eliminate these voids, the catalyst purge cylinder 36 and the carriage assembly 22 are retracted within the base member 14 by selective actuation of the D.C. gear motor 20 causing the drive screw 24 to rotate within the stationary nut assembly 26. After the carriage assembly 22 has been fully retracted within the base member 14, air is applied to the catalyst purge cylinder 36 causing the piston 42 therein to reciprocate several times. Such reciprocation causes MEK peroxide to pass from the catalyst reservoir through the valve body 12 to the catalyst pump cylinder 46 resulting in the evacuation of any oxygen gas which might be present in passageways 60, 72 thus insuring that the exact mixture ratio of resin to catalyst will be provided into the static mixing tube 78.

It should be noted that check valves 56 and 70 can be replaced by a ball valve (not shown) that is manually operated permitting the passage of resin from the resin reservoir into the resin pump cylinder 16 as the carriage assembly 22 retracts and preventing the passage of resin into the combining chamber 68 during this operation. Subsequent actuation of the ball valve permits the passage of resin from the resin pump cylinder 16 to the static mixing tube 78 as the carriage assembly 22 advances and prevents the passage of resin back into the resin reservoir. The use of a similar ball valve for check valves 64 and 76 for the catalyst is not practical because of the aforementioned oxygen purge cycle.

Certain modifications and improvements will occur to those skilled in the art upon reading the foregoing. It should be understood that all such modifications and improvements have been deleted herein for the sake of conciseness and readability, but are properly with the scope of the following claims.

I claim:

1. Apparatus for the precision metering of a first material and a second material and the mixing of same comprising:
   - means for providing a predetermined amount of said fist material;
   - means for providing a predetermined amount of said second material;
   - means for driving said first material providing means and said second material providing means, said driving means comprising a drive screw and a stationary nut assembly which is operatively connected to said fist material providing means and said second material providing means;
   - means for adding said predetermined amount of said second material to said predetermined amount of said fist material; and
   - means for mixing said predetermined amount of said fist material and said predetermined amount of said second material after said predetermined amount of said second material has been added to said predetermined amount of said fist material.

2. Apparatus for the precision metering of a first material and a second material and the mixing of said comprising:
   - means for providing a predetermined amount of said first material;
   - means for providing a predetermined amount of said second material;
   - means for adding said predetermined amount of said second material to said predetermined amount of said fist material, said adding means comprising a hypodermic needle; and
   - means for mixing said predetermined mount of said first material and said predetermined amount of said second material after said predetermined amount of said second material has been added to said predetermined amount of said first material.

3. Apparatus for the precision metering of a first material and a second material and the mixing of said comprising:
   - means for providing a predetermined amount of said first material;
   - means for providing a predetermined amount of said second material;
   - means for adding said predetermined amount of said second material to said predetermined amount of said first material; and
   - means for mixing said predetermined amount of said first material and said predetermined amount of said second material after said predetermined amount of said second material has been added to said predetermined amount of said first material, said adding means being a hypodermic needle and said mixing means being a static mixing tube, said hypodermic needle being positioned so that a portion thereof is received within said static mixing tube.

4. Apparatus for the precision metering of a first material and a second material and the mixing of same comprising:
   - means of providing a predetermined amount of said first material;
   - means for providing a predetermined amount of said second material;
   - means for selectively driving said second material providing means, said selective driving means being operable to drive said second material providing means without driving said first material providing means;
   - means for adding said predetermined amount of said second material to said predetermined amount of said first material; and
   - means for mixing said predetermined amount of said first material and said predetermined amount of said second material after said predetermined amount of said second material has been added to said predetermined amount of said first material.

5. Apparatus for the precision metering of a first material and a second material and the mixing of said comprising:
   - pump means operable to provide a predetermined amount of said first material;
   - means for providing a predetermined amount of said second material;
   - means for adding said predetermined amount of said second material to said predetermined amount of said fist material;
   - means or mixing said predetermined amount of said first material and said predetermined amount of said second material after said predetermined amount of said second material has been added to said predetermined amount of said fist material; and
   - means for preventing the flow of said first material from said pump means to the source of said fist material when the apparatus is in a first mode of operation and from said pump means to said mixing means when the apparatus is in a second mode of operation, said preventing means comprising a first check value fluidicaly connected between said pump means and the source of said first material and a second check valve fluidicaly connected between said pump means and said mixing means.

* * * * *